US010408043B2

(12) United States Patent
Knoeller et al.

(10) Patent No.: US 10,408,043 B2
(45) Date of Patent: Sep. 10, 2019

(54) WELL TESTING WITH JET PUMP

(71) Applicant: WEATHERFORD TECHNOLOGY HOLDINGS, LLC, Houston, TX (US)

(72) Inventors: Michael C. Knoeller, Humble, TX (US); Jason W. Mathews, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 91 days.

(21) Appl. No.: 15/298,708

(22) Filed: Oct. 20, 2016

(65) Prior Publication Data

US 2018/0112516 A1 Apr. 26, 2018

(51) Int. Cl.

| | |
|---|---|
| ***E21B 47/06*** | (2012.01) |
| ***E21B 43/12*** | (2006.01) |
| ***E21B 34/08*** | (2006.01) |
| ***E21B 41/00*** | (2006.01) |
| ***E21B 47/01*** | (2012.01) |
| ***E21B 49/08*** | (2006.01) |
| ***F04F 5/46*** | (2006.01) |

(52) U.S. Cl.

CPC ..... *E21B 47/06* (2013.01); *E21B 34/08* (2013.01); *E21B 41/0078* (2013.01); *E21B 43/12* (2013.01); *E21B 43/124* (2013.01); *E21B 47/011* (2013.01); *E21B 49/087* (2013.01); *F04F 5/464* (2013.01)

(58) Field of Classification Search

CPC ..... E21B 47/06; E21B 43/12; E21B 43/124; E21B 41/0078; E21B 34/08; E21B 47/11; E21B 49/087; F04F 5/00–469

See application file for complete search history.

(56) References Cited

U.S. PATENT DOCUMENTS 2,291,911 A * 8/1942 McMahon ..... E21B 43/124 417/172
4,603,735 A * 8/1986 Black ..... F04F 5/464 166/105
4,846,280 A * 7/1989 Snider ..... E21B 34/10 166/319

(Continued)

OTHER PUBLICATIONS

European Search Report dated Mar. 22, 2018 for EP Patent Application No. 17196335.8, 9 pages.

(Continued)

*Primary Examiner* — George S Gray
(74) *Attorney, Agent, or Firm* — Smith IP Services, P.C.

(57) ABSTRACT

An apparatus can include a jet pump with a nozzle and a throat, a flow passage for conducting production fluid to the throat, and a check valve that prevents flow from the throat to the flow passage and permits flow from the flow passage to the throat. A method can include performing a bottomhole well pressure test while measuring well pressure with a well parameter sensor connected to a jet pump, and then retrieving the well parameter sensor and the jet pump together from the well. A system can include a jet pump sealingly received in a tubular string, the jet pump including a throat that receives a power fluid from a nozzle and receives a production fluid from a flow passage, and a check valve permitting flow of the production fluid from the flow passage to the throat and preventing flow of the power fluid to the flow passage.

20 Claims, 4 Drawing Sheets

(56) References Cited

U.S. PATENT DOCUMENTS

| | | | | |
|---|---|---|---|---|
| 6,050,340 | A * | 4/2000 | Scott | E21B 23/00 166/105 |
| 6,116,340 | A * | 9/2000 | Wilson | E21B 49/008 166/250.17 |
| 9,297,239 | B2 | 3/2016 | Robayo | |
| 2004/0129416 | A1 | 7/2004 | Khomynets | |
| 2008/0115934 | A1 | 5/2008 | Pettinato et al. | |
| 2012/0273221 | A1 | 11/2012 | Robayo | |

OTHER PUBLICATIONS

Weatherford; "Jet, 2.50 D-Short with 22.04 Pitch Length", Drawing No. 429-085, dated Jun. 2, 1998, 1 page.
Weatherford; "Jet-Pump Lifting Systems", Company Article No. 11513.00, dated 2015, 8 pages.

* cited by examiner

WELL TESTING WITH JET PUMP

BACKGROUND

This disclosure relates generally to equipment utilized and operations performed in conjunction with a subterranean well and, in an example described below, more particularly provides apparatus, systems and methods for well testing with a jet pump.

A jet pump uses the Bernoulli principle to draw production fluid toward a relatively low pressure region created when a power fluid pumped from surface flows through a nozzle and into a throat of the jet pump. The power fluid and the production fluid commingle in the throat and then flow through a diffuser (in which pressure in the commingled fluids is increased) before being produced to surface.

A bottomhole well pressure test can be performed to measure static well pressure for production planning, monitoring or diagnostic purposes. Typically, a well is shut in (thereby preventing production flow to surface), and a pressure sensor or gauge is used to measure pressure in the production fluid at a desired downhole location (such as, at a production zone).

It will, therefore, be readily appreciated that it would be desirable to perform a bottomhole well pressure test in circumstances where a jet pump is used for producing fluid from the well. It would also save valuable wellsite time and expense if such a jet pump could be retrieved along with a pressure gauge or recorder used to measure pressure during the test.

DETAILED DESCRIPTION

Figure 1:
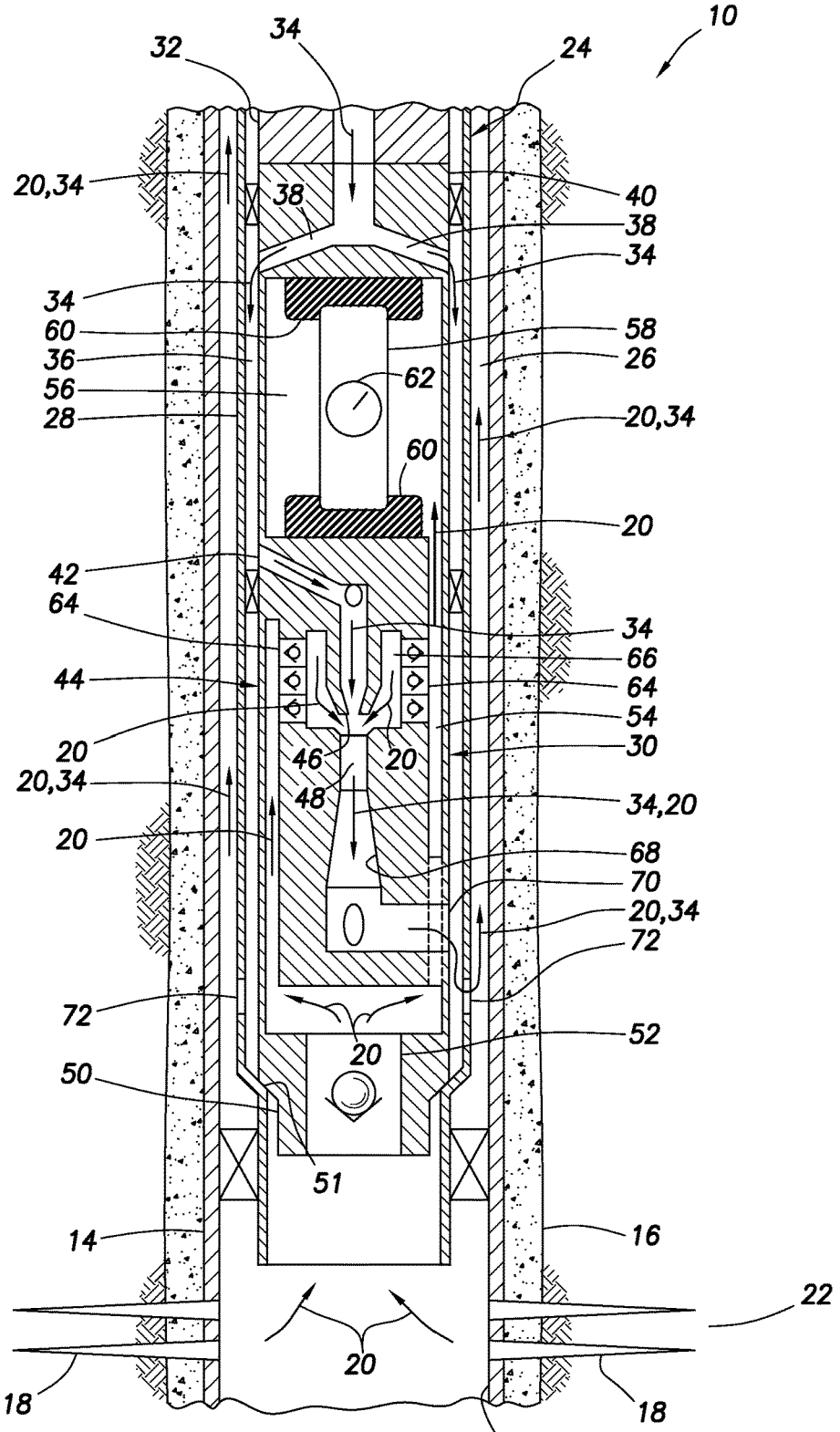
FIG. 1 is a representative partially cross-sectional view of an example of a fluid production system and associated method which can embody principles of this disclosure.

Representatively illustrated in FIG. 1 is a fluid production system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, the well includes a generally vertical wellbore 12 lined with casing 14 and cement 16. Perforations 18 formed through the casing 14 and cement 16 provide for flow of production fluid 20 to an interior of the wellbore 12 from a production zone 22 penetrated by the wellbore 12.

However, in other examples, sections of the wellbore 12 may be inclined or deviated from vertical, the fluid 20 could be produced at an uncased or open hole section of the wellbore 12, etc. Thus, the scope of this disclosure is not limited to any details of the well as depicted in the drawings or described herein.

A tubular string 24 (such as, a production tubing string, a coiled tubing string, etc.) is positioned in the casing 14. An annulus 26 is formed radially between the casing 14 and the tubular string 24.

The tubular string 24 includes a generally tubular bottomhole assembly 28. The assembly 28 is "bottomhole" in that it is connected at or near a distal end of the tubular string 24 in the wellbore 12. The assembly 28 is not necessarily positioned at a bottom of the wellbore 12.

Sealingly received in the bottomhole assembly 28 is a fluid production apparatus 30. The fluid production apparatus 30 may be conveyed into, and retrieved from, the bottomhole assembly 28 by wireline, slickline, coiled tubing, tractor, robot, flow or any other type of conveyance 32 or technique for transporting the apparatus 30 in the tubular string 24.

As depicted in FIG. 1, a power fluid 34 is pumped from surface to the apparatus 30 via the conveyance 32. In other examples, the power fluid 34 may be pumped to the apparatus 30 via the tubular string 24, or via an annulus 36 formed radially between the tubular string 24 and the conveyance 32.

In the FIG. 1 example, the power fluid 34 flows outward into the annulus 36 from ports 38 formed in an upper retrieval connector 40 of the apparatus 30. The power fluid 34 flows through the annulus 36 and enters ports 42 of a jet pump 44.

In the jet pump 44, the power fluid 34 flows through a nozzle 46. This increases a velocity of the power fluid 34 and thereby reduces a pressure in the power fluid.

The nozzle 46 is aligned with a throat 48 of the jet pump 44, so that the power fluid 34 exiting the nozzle 46 at increased velocity and reduced pressure enters the throat 48. There is, however, a gap between the nozzle 46 and the throat 48, into which the production fluid 20 may flow.

The production fluid 20 enters the jet pump 44 via a standing valve 50. The standing valve 50, in this example, is connected below the jet pump 44 in the apparatus 30. The standing valve 50 sealingly engages an internal shoulder 51 formed in the bottomhole assembly 28.

The standing valve 50 is depicted in FIG. 1 as comprising a check valve 52 that permits flow of the production fluid 20 to the jet pump 44 from the wellbore 12 at the production zone 22. The check valve 52 prevents reverse flow of the production fluid 20 from the jet pump 44. However, the scope of this disclosure is not limited to use of any particular type or configuration of the standing valve 50.

The production fluid 20 flows from the standing valve 50 via a flow passage 54 extending longitudinally through the jet pump 44. In the FIG. 1 example, the flow passage 54 extends to a chamber 56 in the apparatus 30 between the jet pump 44 and the upper retrieval connector 40.

Positioned in the chamber 56 is a well parameter recorder 58. The recorder 58 can be a relatively fragile instrument, and so shock dampeners 60 support the recorder 58 at opposite ends of the chamber 56.

The recorder 58 includes a well parameter sensor 62. The sensor 62 can be in communication with the production fluid 20 in the chamber 56, so the sensor 62 can measure a well parameter (such as, pressure, temperature, resistance, capacitance, density, etc.) of the production fluid 20.

The recorder 58 can record such measurements over time. More than one sensor 62 may be used to measure more than one well parameter.

In a bottom hole well pressure test, the sensor 62 may comprise a pressure sensor for measuring pressure in the production fluid 20 in the chamber 56. Such pressure measurements may be performed and recorded before, during and after the well is shut in (i.e., production flow from the production zone 22 ceases).

The flow passage 54 is also in one-way communication with the gap between the nozzle 46 and the throat 48 via one or more check valves 64. The check valves 64 permit flow of the production fluid 20 from the flow passage 54 to a chamber 66 surrounding the gap between the nozzle 46 and the throat 48, but the check valves 64 prevent flow from the chamber 66 to the flow passage 54.

The production fluid 20 flows through the check valves 64 and into the chamber 66. The production fluid 20 in the chamber 66 is drawn into the relatively low pressure region of the power fluid 34 exiting the nozzle 46 (in the gap between the nozzle 46 and the throat 48), and the commingled production and power fluids 20, 34 flow together into the throat 48.

From the throat 48, the fluids 20, 34 flow through a diffuser 68, in which a velocity of the fluid 20, 34 is decreased and a pressure in the fluids 20, 34 is increased. The fluids 20, 34 then exit the jet pump 44 via ports 70.

The fluids 20, 34 flow into the annulus 36 via the ports 70, and then flow into the annulus 26 via ports 72 in the bottomhole assembly 28. The fluids 20, 34 flow to surface via the annulus 26. Thus, the power fluid 34 is injected into the well and, due to the interaction of the jet pump 44 and the remainder of the apparatus 30 and the bottom hole assembly 28, the power fluid 34 and production fluid 20 are flowed to surface.

One benefit of the check valves 64 is that they prevent the power fluid 34 from flowing into the flow passage 54. During a bottom hole well pressure test, the flow passage 54 is desirably isolated from all downhole pressure sources, other than the production fluid 20. The check valves 64 may be useful in other types of tests, as well.

Figure 2:
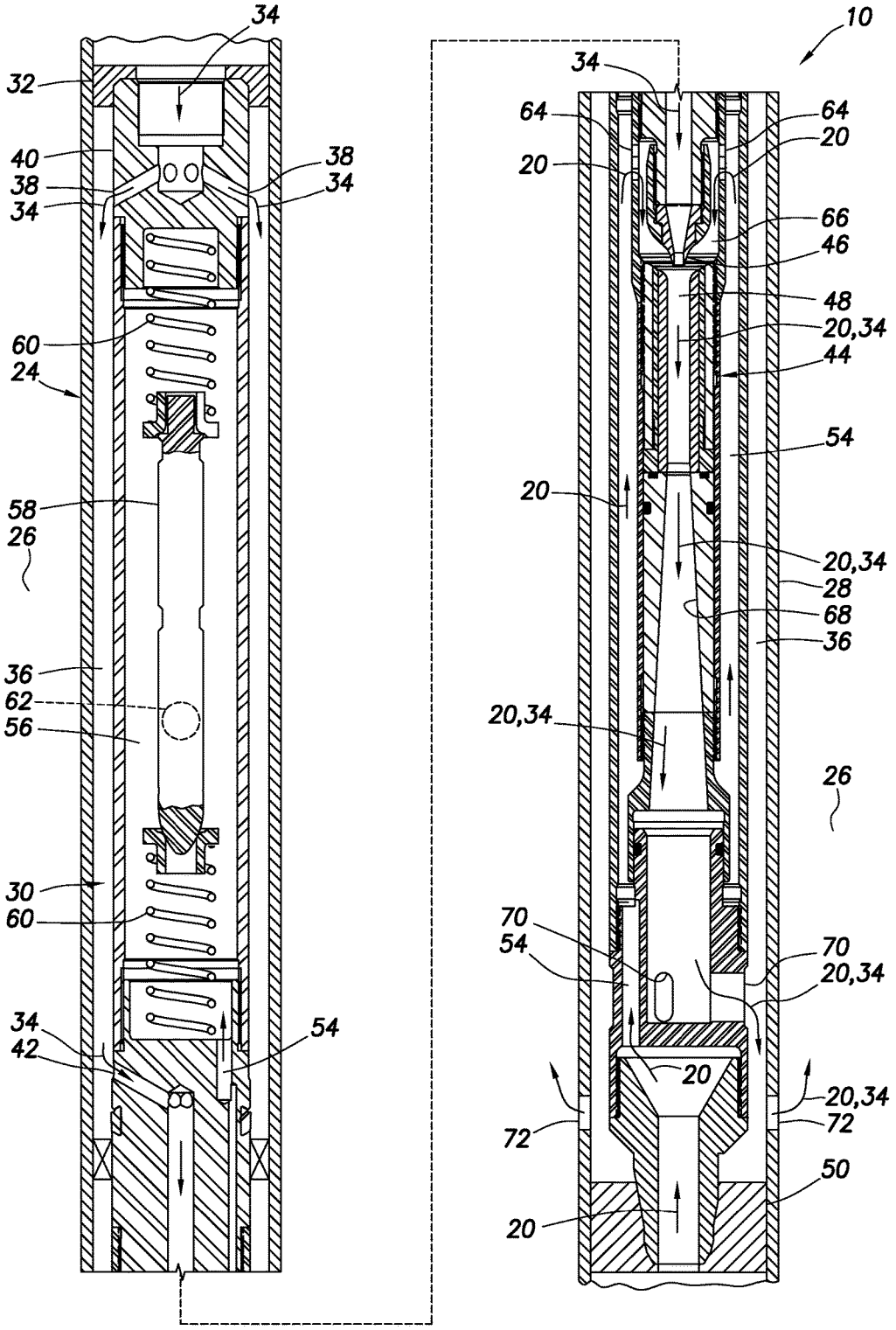
FIG. 2 is a representative cross-sectional view of the fluid production system in a fluid production configuration.

Referring additionally now to FIG. 2, an example of the fluid production system 10 is representatively illustrated apart from the well of FIG. 1. The FIG. 2 fluid production system 10 example may be used in wells other than the well of FIG. 1.

In FIG. 2, further details of the system 10 are visible. Note that the system 10 is depicted in FIG. 2 in a fluid production configuration, with the power fluid 34 being pumped from surface into the annulus 36 via the connector 40, and the commingled production and power fluids 20, 34 flowing to surface via the annulus 26.

The power fluid 34 flows from the annulus 36 through the nozzle 46 to the throat 48. The power fluid 34 becomes commingled with the production fluid 20 in the gap between the nozzle 46 and the throat 48.

The production fluid 20 enters the apparatus 30 via the standing valve 50, which is schematically depicted in FIG. 2. The standing valve 50 may include the check valve 52 of FIG. 1, or another type of valve.

The production fluid 20 flows into the flow passage 54 from the standing valve 50. From the flow passage 54, the production fluid 20 is in communication with the chamber 56, and in one-way communication with the chamber 66. The one-way communication is provided by the check valves 64 connected between the flow passage 54 and the chamber 66.

Figure 3:
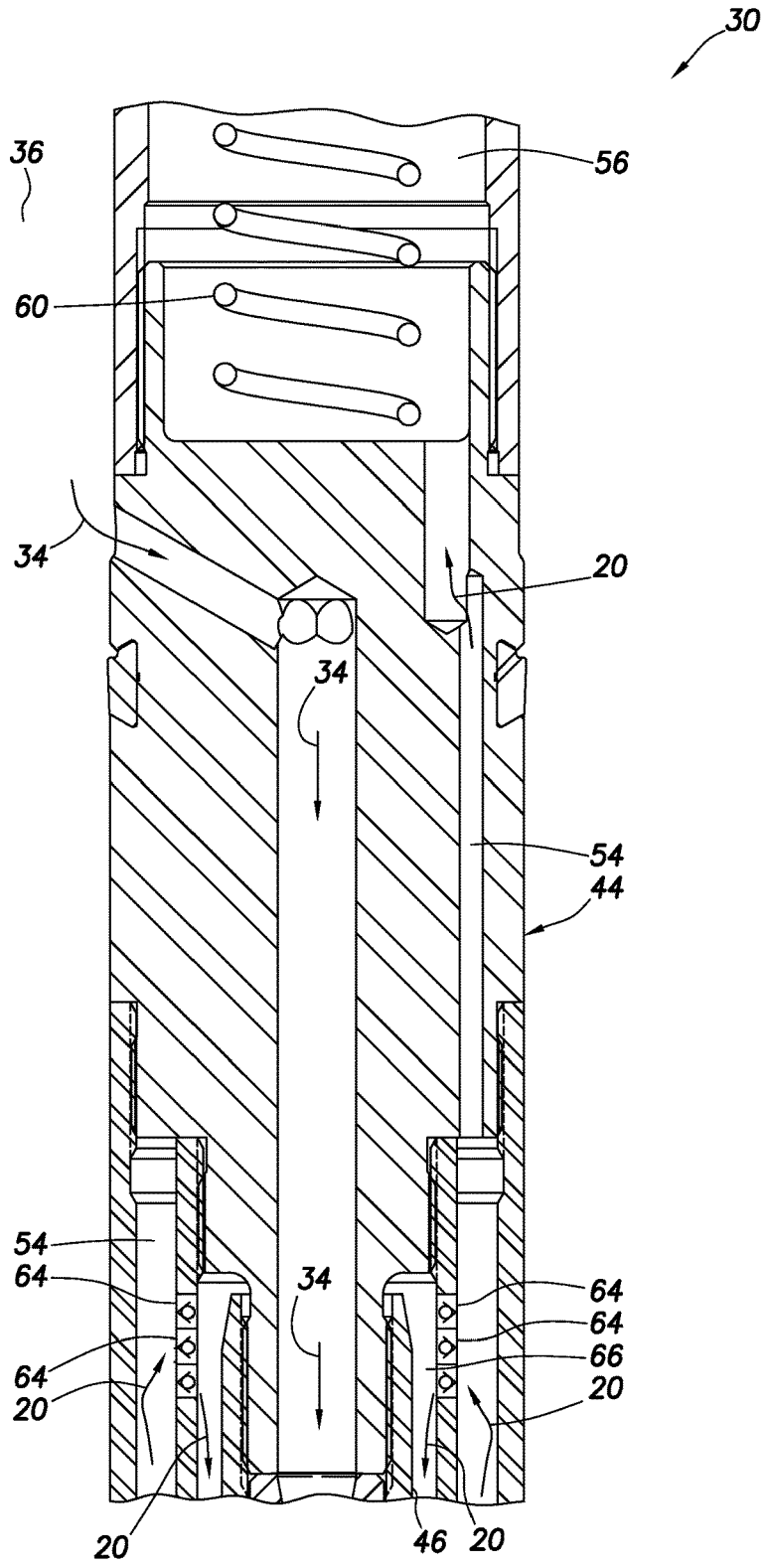
FIG. 3 is a representative cross-sectional view of a section of a jet pump of the fluid production system.

Referring additionally now to FIG. 3, an enlarged scale cross-sectional view of a section of the jet pump 44 is representatively illustrated. In this view, the manner in which the flow passage 54 is in communication with both of the chambers 56, 66, but the chamber 56 is isolated from the chamber 66, can be more clearly seen.

The production fluid 20 can flow from the flow passage 54 to either of the chambers 56, 66. However, the check valves 64 prevent the production and power fluids 20, 34 from flowing from the chamber 66 to the flow passage 54 or chamber 56.

Figure 4:
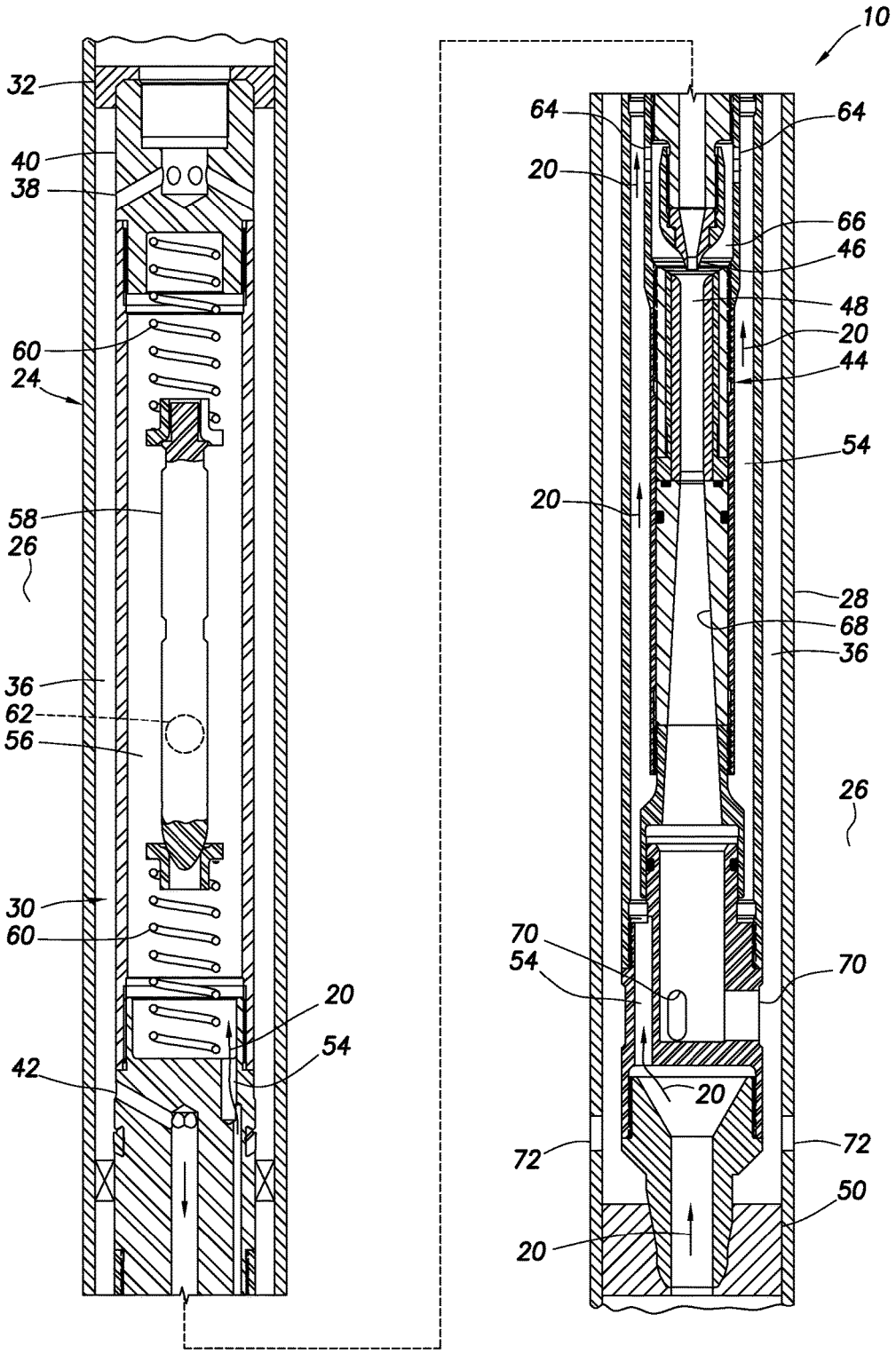
FIG. 4 is a representative cross-sectional view of the fluid production system in a bottomhole well pressure test configuration.

Referring additionally now to FIG. 4, the fluid production system 10 is representatively illustrated in a bottomhole well pressure test configuration. Production flow from the production zone 22 (see FIG. 1) is ceased, so that pressure in the wellbore 12 at the zone 22 will build up to the same as (or substantially the same as) pressure in the zone 22. Thus, by measuring characteristics of pressure in the wellbore 12 (such as, maximum buildup pressure, rate/profile of pressure buildup, etc.), characteristics of the zone 22 may be derived.

Note that the flow passage 54 is in communication with the wellbore 12 at the zone 22 via the standing valve 50. The flow passage 54 is also in communication with the chamber 56 containing the recorder 58. Thus, the sensor 62 can measure a well parameter (such as, pressure, temperature, etc.) in the production fluid 20.

During the bottomhole well pressure test, the power fluid 34 is not flowed through the apparatus 30. Nonetheless, the check valves 64 prevent pressure in the chamber 66 from being communicated to the flow passage 54 and chamber 56, so that the pressure measurements are unaffected by pressures in the chamber 66, annulus 26 and annulus 36.

After the bottomhole well pressure test, the apparatus 30, including the jet pump 44, the standing valve 50 and the recorder 58 can be conveniently retrieved from the tubular string 24 together. Thus, at most, a single trip into the well may be used to retrieve the apparatus 30 in this example, thereby saving wellsite time and expense.

In FIGS. 2 & 4, the conveyance 32 is depicted schematically. If the conveyance 32 comprises a wireline, slickline or coiled tubing, then the conveyance 32 can be connected to the retrieval connector 40 and withdrawn from the well to retrieve the apparatus 30 with the conveyance 32.

In other examples, the apparatus 30 could be conveyed in the tubular string 24 by flow through the tubular string 24. In these examples, upward flow (e.g., in a reverse circulating direction) through the tubular string 24 may be used to retrieve the apparatus 30 from the tubular string 24.

In still further examples, a tractor or robot may be used as the conveyance 32 to autonomously, or semi-autonomously, install and/or retrieve the apparatus 30. The robot or tractor may remain in the well between installation and retrieval of the apparatus 30, or the robot or tractor may be removed from the well until retrieval of the apparatus 30 is desired.

If the conveyance 32 comprises a coiled tubing or other type of tubing, the power fluid 34 may be flowed through the tubing to the apparatus 30 during production. The conveyance 32 could include packers or other sealing devices for sealing off the annulus 36 between the apparatus 30 and the bottomhole assembly 28.

If the conveyance 32 comprises a wireline or slickline, a packer nose with a fishing neck may be provided above, or as a part of, the retrieval connector 40. The power fluid 34 in these examples could be pumped through the tubular string 24 to the apparatus 30 sealingly received in the bottomhole assembly 28.

It may now be fully appreciated that the above disclosure provides significant advancements to the arts of constructing and operating fluid production systems for wells. In one example described above, the fluid production system 10 allows the jet pump 44 to be used for producing fluid 20 to surface, while still allowing the jet pump 44 and a recorder 58 to be retrieved together from a well after a bottom hole well pressure test.

The above disclosure provides to the art a fluid production apparatus 30 for use with a subterranean well. In one example, the fluid production apparatus 30 can include a jet pump 44 with a nozzle 46 aligned with a throat 48, a flow passage 54 configured for conducting production fluid 20 to the throat 48, and at least one check valve 64 that prevents flow from the throat 48 to the flow passage 54 and permits flow from the flow passage 54 to the throat 48.

The flow passage 54 may extend longitudinally beyond both of opposite ends of the jet pump 44.

The fluid production apparatus 30 can also include a well parameter sensor 62 in communication with the flow passage 54. The check valve 64 may prevent flow from the throat 48 to the well parameter sensor 62. The well parameter sensor 62 may be included with a well parameter recorder 58.

The well parameter sensor 62 may be disposed longitudinally between the jet pump 44 and a retrieval connector 40 configured for retrieving the fluid production apparatus 30 from the well. The jet pump 44 may be disposed longitudinally between the well parameter sensor 62 and a standing valve 50.

A production method for use with a subterranean well is also provided to the art by the above disclosure. In one example, the method can comprise: performing a bottomhole well pressure test while measuring well pressure with a well parameter sensor 62 connected to a jet pump 44 in the well; and after the bottomhole well pressure test, retrieving the well parameter sensor 62 and the jet pump 44 together from the well.

The well parameter sensor 62 may be included with a well parameter recorder 58, and the measuring step may include recording measurements of the well pressure.

The method may include connecting the jet pump 44 between the well parameter sensor 62 and a standing valve 50. The method may include connecting the well parameter sensor 62 between the jet pump 44 and a retrieval connector 40 configured for retrieving the jet pump 44 and the well parameter sensor 62 from the well.

The well parameter sensor 62 may be in communication with a flow passage 54 that receives production fluid 20 from a production zone 22 of the well. The method may include at least one check valve 64 permitting flow from the flow passage 54 to a throat 48 of the jet pump 44 and preventing flow from the throat 48 to the flow passage 54. The method may include the check valve 64 preventing flow from the throat 48 to the well parameter sensor 62.

A fluid production system 10 for use with a subterranean well is also described above. In one example, the fluid production system 10 can include a jet pump 44 sealingly received in a bottomhole assembly 28 connected in a tubular string 24, the jet pump 44 comprising a throat 48 that receives a power fluid 34 from a nozzle 46 and receives a production fluid 20 from a flow passage 54, the jet pump 44 further comprising at least one check valve 64 that permits flow of the production fluid 20 from the flow passage 54 to the throat 48 and prevents flow of the power fluid 34 to the flow passage 54.

The fluid production system 10 may also include a well parameter sensor 62 connected to the jet pump 44. The check valve 64 may prevent flow of the power fluid 34 to the well parameter sensor 62.

The fluid production system 10 may include a standing valve 50, with the jet pump 44 being connected longitudinally between the standing valve 50 and the well parameter sensor 62.

The jet pump 44 and the well parameter sensor 62 may be retrievable together from the bottomhole assembly 28. The well parameter sensor 62 may be connected between the jet pump 44 and a retrieval connector 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A fluid production apparatus for use with a subterranean well, the fluid production apparatus comprising:

a jet pump including a throat which receives a power fluid from a nozzle, a flow passage configured for conducting production fluid to the throat, and at least one check valve that prevents flow from the throat to the flow passage and permits flow from the flow passage to the throat; and at least one well parameter sensor, wherein the well parameter sensor is positioned above the jet pump, and wherein the well parameter sensor detects a property of the production fluid in a chamber without the power fluid commingled therein.

2. The fluid production apparatus of claim 1, wherein the well parameter sensor is in communication with the flow passage.

3. The fluid production apparatus of claim 2, wherein the check valve prevents flow from the throat to the well parameter sensor.

4. The fluid production apparatus of claim 2, wherein the well parameter sensor is included with a well parameter recorder.

5. The fluid production apparatus of claim 2, wherein the well parameter sensor is disposed longitudinally between the jet pump and a retrieval connector configured for retrieving the fluid production apparatus from the well.

6. The fluid production apparatus of claim 2, wherein the jet pump is disposed longitudinally between the well parameter sensor and a standing valve.

7. The fluid production apparatus of claim 1, wherein the flow passage extends longitudinally beyond both opposite ends of the jet pump.

8. A production method for use with a subterranean well, the method comprising:

performing a bottomhole well pressure test while measuring well pressure with a well parameter sensor connected to a jet pump in the well, wherein the well parameter sensor is positioned to sense a property of the production fluid within a chamber above the jet pump, and wherein the well parameter sensor is hydraulically isolated from a power fluid which operates the jet pump; and after the bottomhole well pressure test, retrieving the well parameter sensor and the jet pump together from the well.

9. The method of claim 8, wherein the well parameter sensor is included with a well parameter recorder, and wherein the measuring includes recording measurements of the well pressure.

10. The method of claim 8, further comprising connecting the jet pump between the well parameter sensor and a standing valve.

11. The method of claim 8, further comprising connecting the well parameter sensor between the jet pump and a retrieval connector configured for retrieving the jet pump and the well parameter sensor from the well.

12. The method of claim 8, wherein the well parameter sensor is in communication with a flow passage that receives production fluid from a production zone of the well.

13. The method of claim 12, further comprising at least one check valve permitting flow from the flow passage to a throat of the jet pump and preventing flow from the throat to the flow passage.

14. The method of claim 13, further comprising the check valve preventing flow from the throat to the well parameter sensor.

15. A fluid production system for use with a subterranean well, the fluid production system comprising:

a jet pump sealingly received in a bottomhole assembly connected in a tubular string, the jet pump comprising a throat that receives a power fluid from a nozzle and receives a production fluid from a flow passage, the jet pump further comprising at least one check valve that permits flow of the production fluid from the flow passage to the throat and prevents flow of the power fluid to the flow passage; and at least one well parameter sensor, wherein the well parameter sensor is positioned above the jet pump, and wherein the well parameter sensor detects a property of the production fluid in a chamber without the power fluid commingled therein.

16. The fluid production system of claim 15, wherein the well parameter sensor is in communication with the flow passage.

17. The fluid production system of claim 15, wherein the check valve prevents flow of the power fluid to the well parameter sensor.

18. The fluid production system of claim 15, further comprising a standing valve, the jet pump being connected longitudinally between the standing valve and the well parameter sensor.

19. The fluid production system of claim 15, wherein the jet pump and the well parameter sensor are retrievable together from the bottomhole assembly.

20. The fluid production system of claim 15, wherein the well parameter sensor is connected between the jet pump and a retrieval connector.

* * * * *